United States Patent [19]

Cary et al.

[11] 4,225,988

[45] Oct. 7, 1980

[54] ORTHO-TURN BED

[76] Inventors: George R. Cary, 3439 Prytania St., New Orleans, La. 70115; Noelie B. Pfisterer, 6970 Argonne Blvd., New Orleans, La. 70124

[21] Appl. No.: 7,824

[22] Filed: Jan. 30, 1979

[51] Int. Cl.[3] ..... A61G 7/10

[52] U.S. Cl. ..... 5/61; 5/63; 5/66

[58] Field of Search ..... 5/60, 61, 63, 66–68

[56] References Cited

U.S. PATENT DOCUMENTS

| | | | |
|---|---|---|---|
| 156,318 | 10/1874 | Supplee | 5/60 |
| 348,910 | 9/1978 | Horner | 5/66 |
| 2,113,286 | 4/1938 | White | 5/63 |
| 3,036,314 | 5/1962 | Wetzler | 5/63 |
| 3,564,625 | 2/1971 | Danielson | 5/66 |
| 3,775,781 | 12/1973 | Bruno et al. | 5/63 |
| 3,862,454 | 1/1975 | Mazzucconi | 5/63 |
| 4,084,274 | 4/1978 | Willis | 5/67 |
| 4,127,906 | 12/1978 | Zur | 5/66 |

*Primary Examiner*—Casmir A. Nunberg
*Attorney, Agent, or Firm*—Cushman, Darby & Cushman

[57] ABSTRACT

A bed assembly including a plurality of mattress support members that can be moved to an articulated position with respect to a straight line interconnecting the centers of the members, and which also can be moved to an angled position to roll a person on the bed from one side to the other as desired, which is especially useful for hospital beds. An actuator for moving the patient include first and second levers, a rotatable shaft, and a cable interconnecting the shaft and the levers. Actuating means for moving the support members to the articulated position can be of a conventional type, the lever, cable, and shaft actuating means not interferring with the operation thereof.

13 Claims, 10 Drawing Figures

10
12
36
37
35
24
14

70
71

ORTHO-TURN BED

BACKGROUND AND SUMMARY OF THE INVENTION

The invention relates to a bed assembly, for particular use in hospitals, which allows elevation of the head and foot portions thereof and additionally, facilitates the easy turning of a patient in the bed. In order to prevent development of decubitus ulcers, and to aid in sheet changes, dressing changes, etc., and to provide ease and security for a patient while sitting on the side of the bed with legs dangling over the bed side (which leg dangling can be important therapeutically), it is desirable to be able to turn bed patients easily in their beds, and provide support for the patient while sitting on the side of the bed. Heretofore, there have been proposals for providing split mattresses to allow a patient to be maintained on his side while in bed (see U.S. Pat. No. 2,113,286) and there have been proposals to allow upturning of side portions of the bed while also providing for head elevation (see U.S. Pat. No. 348,910); however heretofore there has been no suitable mechanism for providing for ready turning of a patient in bed and at the same time allowing conventional articulation of the bed to provide both head and foot elevation.

According to the present invention, an apparatus is provided which allows for ready turning of a patient in the bed, which turning can be accomplished by only a single nurse, with less help being necessary from the patient, and with less stress on the patient. Additionally, the bed assembly is capable of supporting a patient in an upright position sitting on the side of the bed with legs dangling over the bed. At the same time, the conventional head and foot elevation of conventional hospital beds is provided for, the turning mechanism not interferring with the head and feet elevation supporting means, and vice versa.

According to the present invention, a bed assembly is provided comprising a frame and a plurality of mattress support members adapted to be supported by the frame, including at least three first members and at least three second members. First pivot means are provided for mounting the first members with respect to each other and the second members with respect to each other, so that the members are movable from a first position wherein the first members are substantially planar with each other and with the second members, to a second position wherein the first and second members assume an articulated position with respect to a straight line interconnecting the centers of the member. The term "articulated position" as used in the present specification and claims means that the head, body, and foot portions of the bed, which are provided by the three first members and the three second members, may assume angular positions with respect to each other and with respect to the bed frame.

The bed assembly according to the invention also comprises second pivot means for mounting the first members with respect to the second members so that the first members are movable from a first position wherein they are substantially planar with the second members, to a third position wherein they make a positive angle relative to the horizontal and with respect to the second members. First actuating means are provided for effecting movement of the first and second members about the first pivot means from the first position to said second position and vice vera, and second actuating means are provided for effecting movement of the first members about the second pivot means from the first to the third position thereof, and vice versa.

The first pivot means comprise hinges disposed on the tops of the support members interconnecting the head and body members of each of the first and second members, and hinges disposed on the bottoms of the members interconnecting the body and feet members of each of the first and second members. The second pivot means comprises hinges disposed between the head, body, and feet members, respectively, of the first and second members.

The first actuating means, for effecting movement of the first and second members about the first pivot means to the articulated position thereof, may comprise any suitable conventional arrangement, such as is provided in the "Borg Warner Electrical Bed, Ser. No. 11040, Model No. 362", and such as shown in U.S. Pat. No. 3,036,314, the disclosure of which is hereby incorporated by reference herein. The second actuating means comprises lever means including a first lever mounted at a first end thereof to one of the first support members and having a second end, a second lever pivotally mounted at a first end thereof to one of the first support members and pivotally mounted at a second end thereof to said first lever intermediate the ends thereof; a shaft; and a cable, or a like force transmitting mechanism, attached to the second end of the first lever, and wrapped around the shaft, rotation of the shaft modifying the effective length of the cable and resulting in pivotal movement of the first support members about the second pivot means. A hand crank may be provided for effecting rotation of the shaft, the hand crank including a toothed gear wheel and detent lever for maintaining the shaft in the position to which it has been moved.

It is the primary object of the present invention to provide a hospital bed assembly to facilitate patient turning while still allowing head and feet elevation. This and other objects of the invention will become clear from an inspection of the detailed description of the invention, and from the appended claims.

DETAILED DESCRIPTION OF THE DRAWINGS

Figure 2:
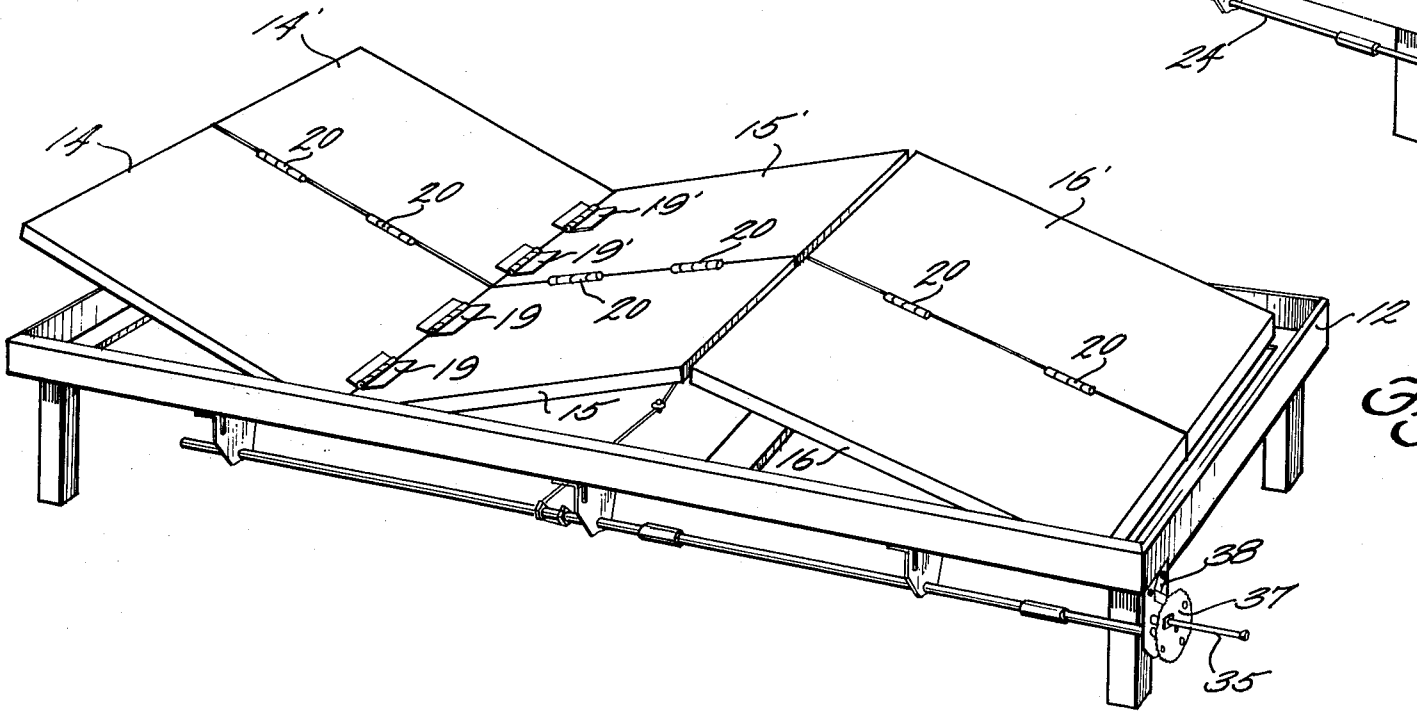
FIG. 2 is a perspective view of the bed assembly of FIG. 1 illustrated in the articulated position thereof, with head and feet elevation.
Figure 3:
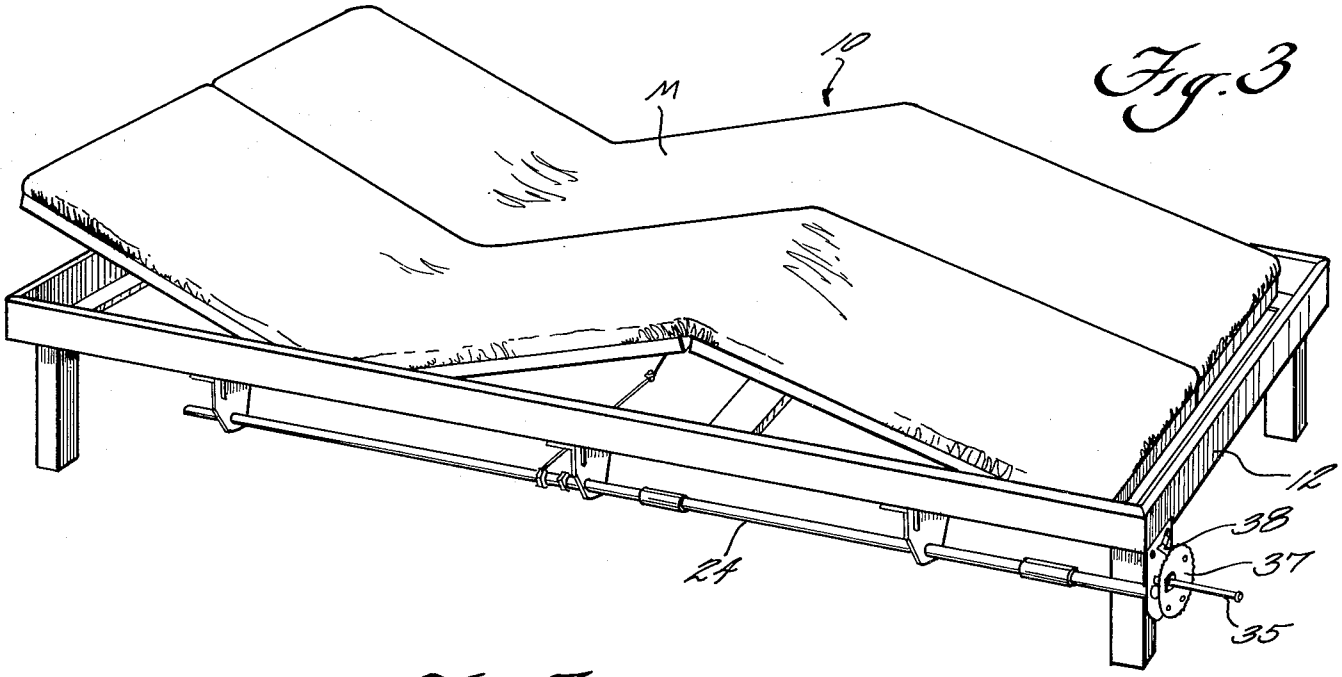
FIG. 3 is a perspective view identical to that of FIG. 2 only showing the mattress in place.
Figure 4A:
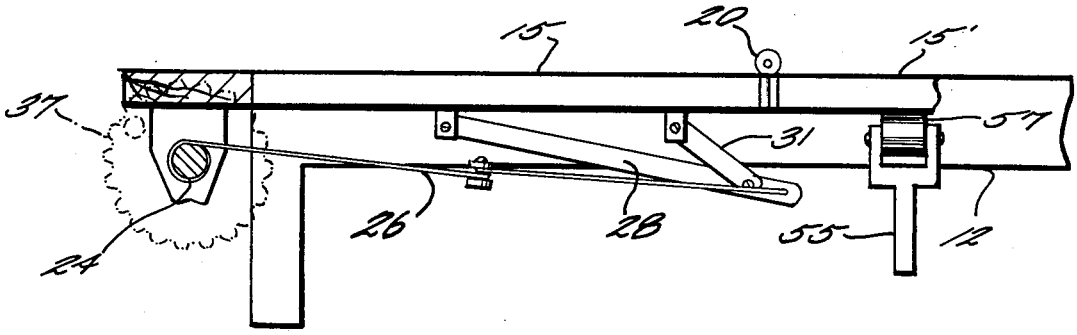
FIGS. 4*a* and 4*b* are end, schematic views illustrating operation of the bed for patient turning.
Figure 5B:
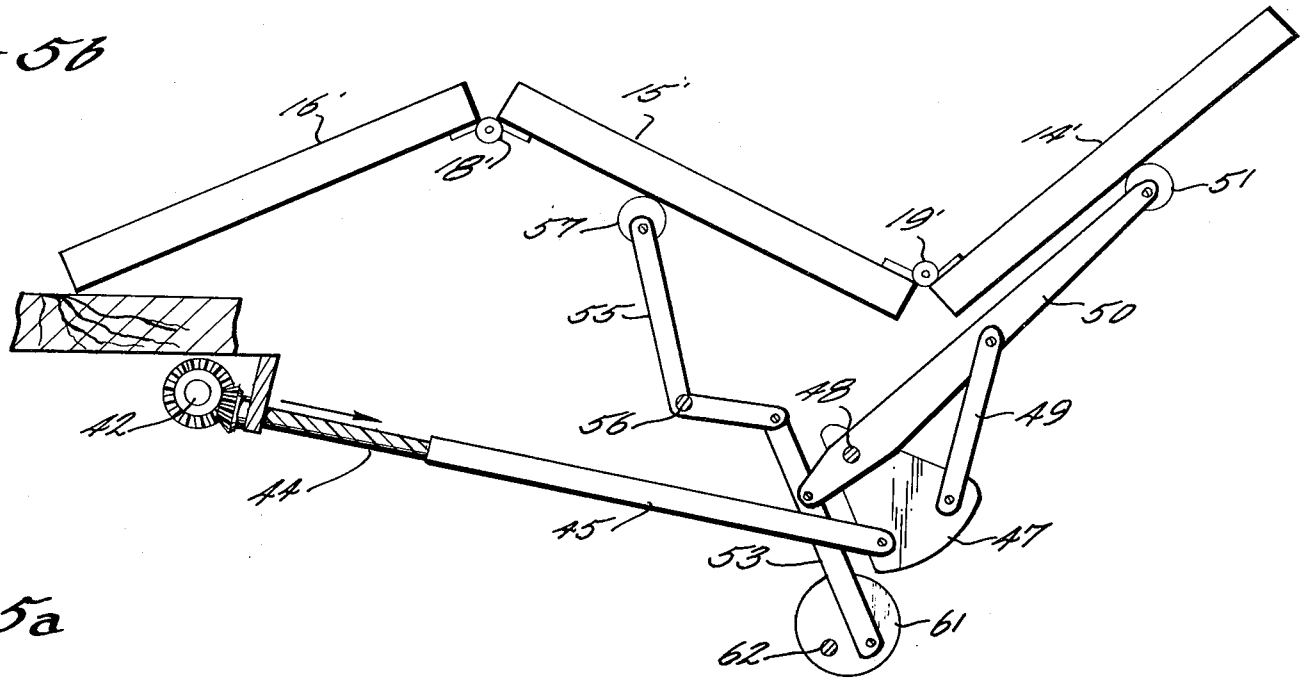
FIGS. 5*a* and 5*b* are side, schematic views illustrating exemplary mechanisms for effecting movement of the bed to an articulated position.

A bed assembly according to the present invention is illustrated generally at 10 in the drawings. The assembly 10 includes a frame 12, and a plurality of mattress support members adapted to be supported by the frame 12, and for supporting a split Mattress M (see FIG. 3). The support members include at least three first members including a head member 14, body member 15, and foot member 16, and at least three second members including a head member 14', a body member 15', and a foot member 16'. First pivot means are provided for mounting the members 14, 15, 16, with respect to each other, and with respect to the members 14', 15', 16', so that the members are movable from a first position wherein the first members 14, 15, 16, are substantially planar with each other and with the second members (see FIGS. 4*a* and 5*a*) to a second position wherein the first and second members assume an articulated position with respect to a straight line interconnecting the center of the members, as illustrated in FIGS. 2, 3, and 5*b*. The first pivot means include hinges 18 disposed on the bottom of the members and interconnecting the feet and body members 16, 15, and corresponding hinges 18', connecting the foot and body members 16', 15' and hinges 19, disposed on the top of the members and interconnecting head member 14 and body member 15, and corresponding hinges 19', interconnecting head member 14' and body member 15'.

Figure 1:
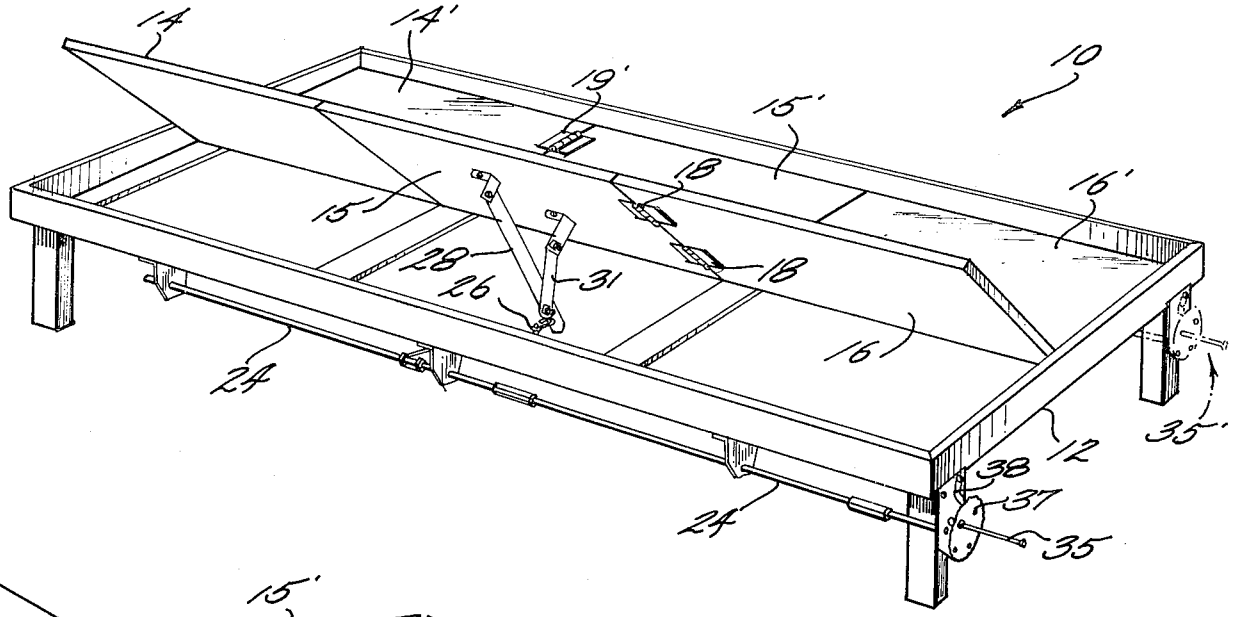
FIG. 1 is a perspective view of an exemplary bed assembly according to the present invention, with mattress removed, illustrated in a patient-turning facilitating position.
Figure 7:
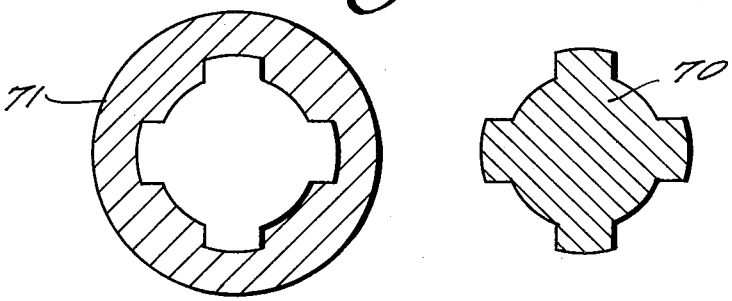
* and FIG. 7 is a cross-sectional view of the major components of the retaining mechanism of FIGS. 6*a* and 6*b*.
Figure 6A:
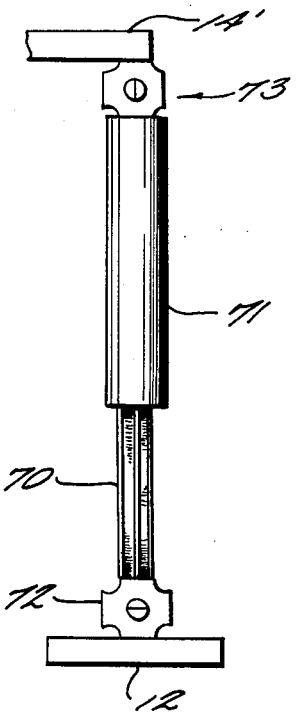
FIGS. 6*a* and 6*b* are side, schematic views illustrating the operation of exemplary retaining mechanisms utilizable in place of the actuating mechanisms in FIGS. 5*a* and 5*b.
Figure 6B:
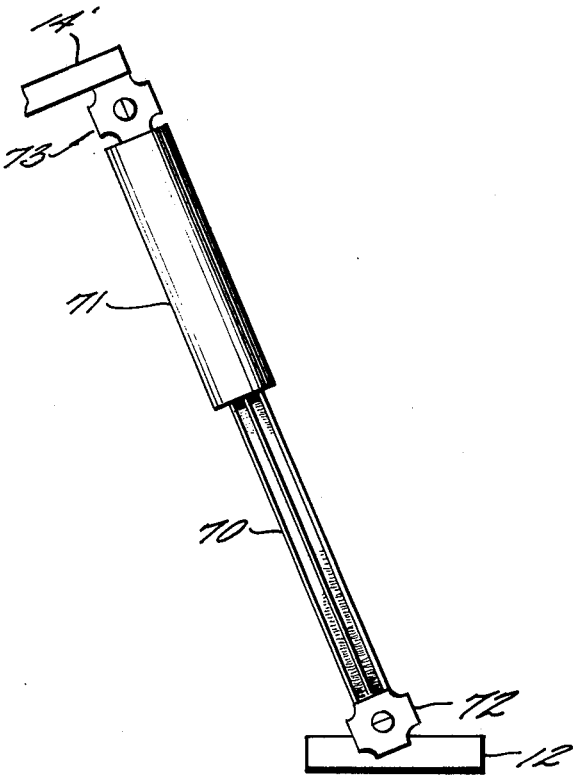
Figure 4B:
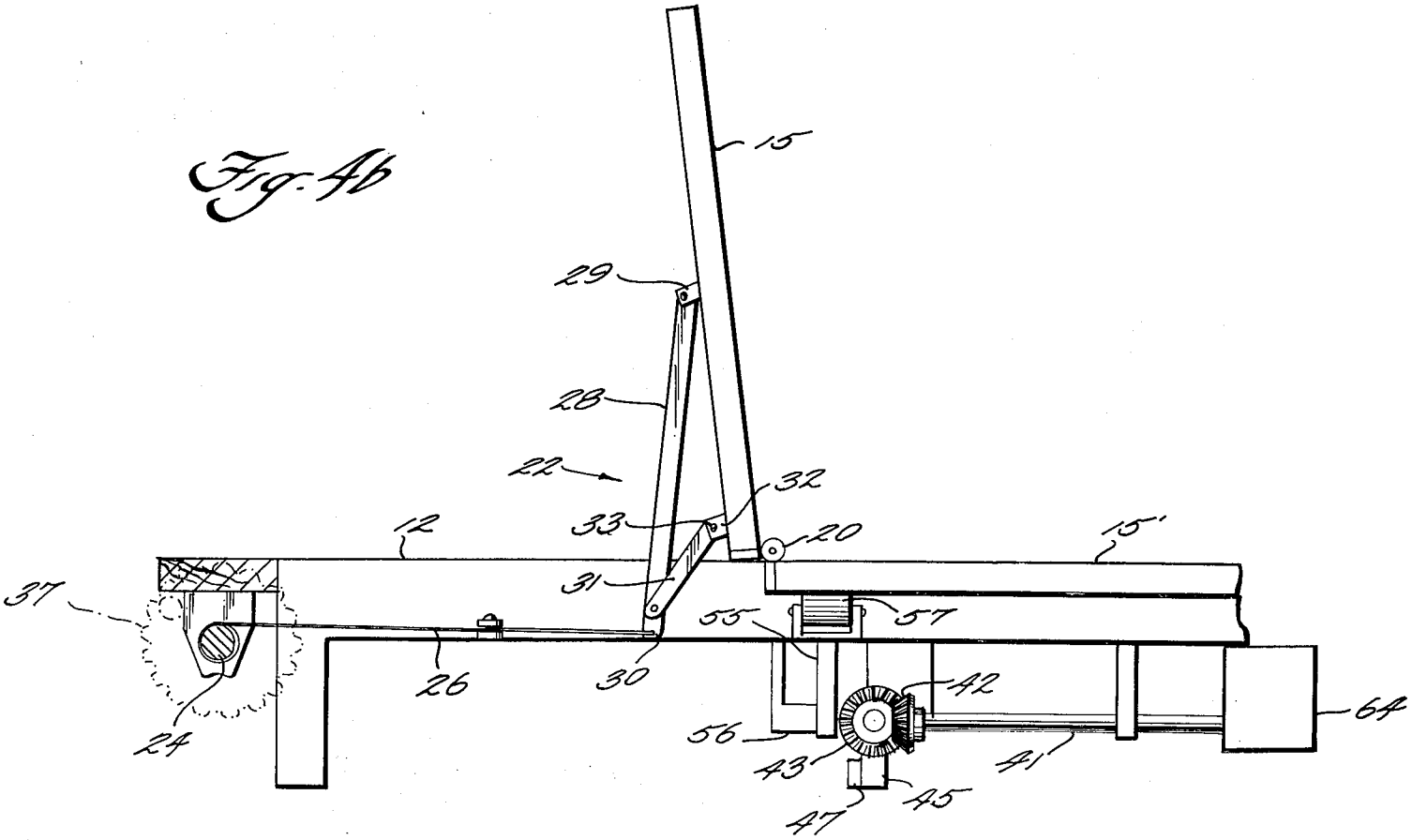

The bed assembly 10 further comprises second pivot means for mounting the members 14, 15, 16, with respect to the members 14', 15', 16', so that the members 14, 15, 16, are movable from a position wherein they are substantially planar with the second members, to a third position wherein they make a positive angle relative to the horizontal and with respect to the members 14', 15', 16', such third position being illustrated in FIGS. 1 and 4*b*. The second pivot means include hinges 20 mounted on the tops of the members and interconnecting the head members 14, 14', body members 15, 15', and food members 16, 16', respectively (see FIGS. 2, 4*a* and 4*b*, in particular). First actuating means are provided for effecting movement of the first and second members about the first pivot from the first to the second positions, and vice versa, which actuating means may comprise any conventional head and feet elevating mechanism that will not interfere with the patient-turning operation of the bed, such a mechanism being illustrated in U.S. Pat. No. 3,036,314, the disclosure of which is hereby incorporated by reference herein. Alternatively, the support members may be moved to their articulated position manually and retaining means may be provided for retaining the first and second members in the second position thereof once they have been moved thereto. Exemplary retaining means are illustrated in FIGS. 6*a*, 6*b*, and 7, which means will be hereinafter described.

The bed assembly 10 also comprises second actuating means for effecting movement of the first members 14, 15, 16 about the second pivot means from the first to the third positions thereof and vice versa. Exemplary second actuating means are illustrated most clearly in FIGS. 1, 4*a*, and 4*b*, and include lever means 22 operatively attached to at least one of the first members (e.g., 15), a shaft 24, and force transmitting means for interconnecting the shaft 24 and the lever means 22 for transforming rotation of the shaft 24 into movement of the lever means 22 to effect pivoting of the first members about the second pivot means (hinges 20) without interference with the first actuating means. The force transmitting means preferably comprises a cable 26, rotation of the shaft 24 modifying the effective length of the cable 26 by wrapping the cable 26 around the shaft 24, or by letting it out. The lever means 22 preferably comprises a first lever 28 pivotally mounted at a first and 29 thereof to member 15, and having a second end 30; a second lever 31 pivotally mounted at a first end 32 thereof to the member 15 and pivotally mounted at a second and 33 thereof to the first lever 28 intermediate the ends thereof; and the cable 26 being attached to the second end 30 of the first lever 28.

Any suitable mechanism may be employed for rotating the shaft 24, such as a hand crank 35, and detent means may be provided for maintaining the shaft 24 in the position to which it has been rotated. Preferably, the hand crank 35 includes a toothed gear wheel 37, and the detent means comprises a detent lever 38 spring biased into engagement with the teeth of the gear wheel 37, but movable against the spring bias to allow cranking of the hand crank 35. While the second actuating means has been described relative to only one set of support members (i.e., 14, 15, 16), another such means may be provided associated with the other set of support members (e.g., 14', 15', 16'), as illustrated schematically at 35' in FIG. 1.

Exemplary first actuating means, such as are generally provided in U.S. Pat. No. 3,036,314, are illustrated most clearly in FIGS. 4*b*, 5*a* and 5*b*. The purpose of such first actuating means is to pivot the head members 14, 14', with respect to the body members 15, 15', about the hinges 19, 19', and simultaneously pivot the foot members 16, 16', with respect to the body members 15, 15', about the hinges 18, 18'. Such means includes a rotatable shaft 41 having a bevel gear 42 formed at one end thereof, and cooperating with a bevel gear 43 attached to a screw rod 44. The screw rod 44 cooperates with an elongated internally threaded nut or threaded extension member 45, rotational movement of the screw rod 44 resulting in linear movement of the extension 45 as indicated by the arrows in FIGS. 5*a* and 5*b*. The extension member 45 is pivoted at 46 to a member 47, which member 47 is operatively pivoted at pivot point 48 to the frame 12. Pivotal movement of the member 47 about pivot point 48 as a result of the linear movement of extension member 45 is transformed into upward pivotal movement of the support member 14' by the lever 49 interconnected to the lever 50, and having an abutting roller 51 formed at one end thereof for engaging the bottom of the support member 14'. Upward movement of the member 14' is simultaneously also transformed into pivotal movement of the members 15', 16', since the lever 50 is connected at pivot point 52 to a lever 53, pivoted at one end 54 thereof to a bell crank lever 55, which in turn is pivoted to the frame 12 at 56 and includes an abutting roller 57 at an end thereof for engaging the bottom of the support member 15', remote from the hinge 19' and adjacent the hinge 18'. The opposite end of the lever 53 is pivoted at 60 to the member 61, which is pivoted at 62 to the frame member. While such actuating means have been shown in their simplest form in the drawings, it is to be understood that a lost motion mechanism can be provided at the interconnection between levers 50 and 53 to result in a greater degree of movement of the head member 14' with respect to the body and foot members 15', 16', and various adjusting mechanisms can be also provided, and a latching mechanism for latching the lever 50 in its upwardmost position (FIG. 5*b*), may also be provided, all as described in U.S. Pat. No. 3,036,314.

While the interconnections between the members 14, 14', 15, 15', 16, 16', provided by the hinges 20, require only one set of levers 50, 55, to be employed to effect the movement of the members into the desired articulated position, it is to be understood that a dual set of levers 50, 55, may be provided if desired, one associated with each of the first and second support members. Such an arrangement would not interfere with the second actuating mechanism.

The shaft 41 which powers the movement into the articulated position may be rotated by any suitable means, such as a hand crank, electric motor 64 (see FIG. 4*b*), or the like.

If desired, instead of using a powered first actuating mechanism, the members 14, 14', 15, 15', 16, 16', may be moved to their articulated position manually, and retained in that position by retaining means as illustrated in FIGS. 6*a*, 6*b*, and 7. Such retaining means comprise a plurality of splined shafts 70 cooperating with splined collars 71, universal joint means 72 connectng each shaft 70 to the frame 12 and means 73 being provided for abutting a desired support member (e.g., 14') to operatively connect the collar 71 to that support member. Any suitable conventional means can be provided for latching the members 70, 71 in the relative position to which they have been moved (e.g., a set screw).

OPERATION; PATIENT TURNING

Figure 5A:
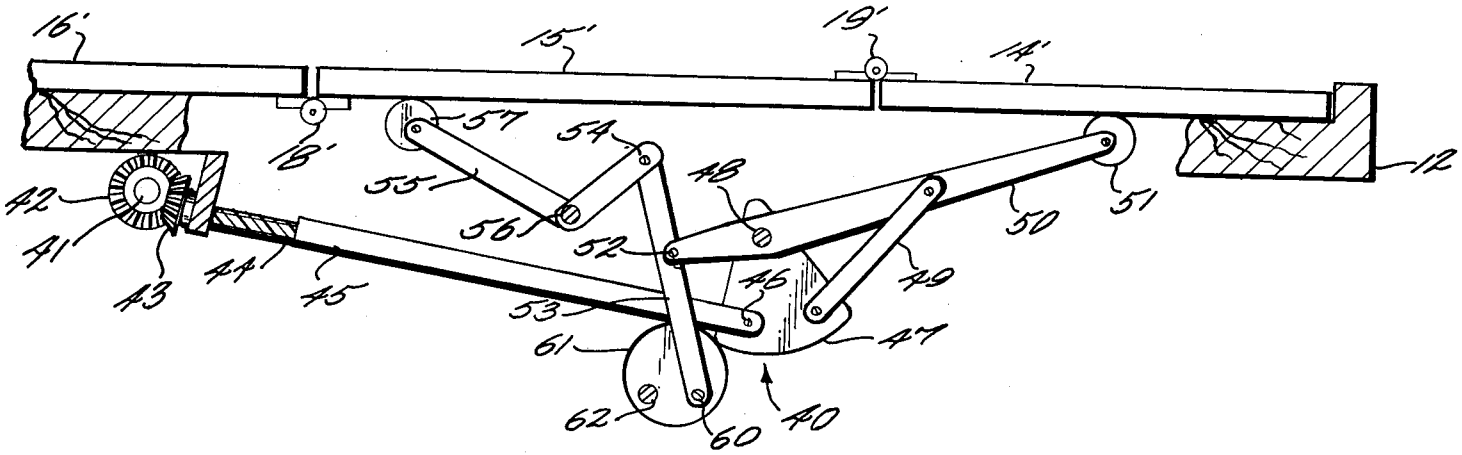

Normally, the bed assembly 10 will be in the position illustrated in FIGS. 4*a* and 5*a*, wherein a flat horizontal planar surface is provided with a mattress M disposed on top of the support members. However, when it is desired to turn a patient to prevent development of decubitus ulcers, aid in sheet changing, or the like, the nurse or attendant will release detent lever 38 from engagement with the toothed wheel 37, and rotate hand crank 35, resulting in rotation of shaft 24 and shortening the effective length of the cable 26, the first members 14, 15, 16, pivoting about the pivots 20 to effect turning of the patient. An exemplary turning position is illustrated in FIG. 1. Because of the relationship of the hinges 18, 19, 20, to the support members 14, 15, 16, only one lever mechanism 22 need be provided to effect movement of all of the first support members 14, 15, 16. In order to provide proper support for a patient so that the patient may feel secure in sitting on the side of the bed with his feet dangling over the edge, the shaft 24 is rotated still further, the cable 26 pulling on end 30 of lever 28 and moving the first members until they are in the position illustrated in FIG. 4*b*. At this position, the detent lever 38 is released and automatically moves into engagement with the toothed gear wheel 37 latching the shaft 24 in place. To lower the first support members, it is necessary only to again release the detent 38, rotate the hand crank 35 in the opposite direction whereby the effective length of the cable 26 increases, being let out from the shaft 24, and the first support members 14, 15, 16, moving downwardly under the force of gravity into the first position (FIGS. 4*a* and 5*a*) thereof.

OPERATION FOR HEAD AND FEET ELEVATION

When it is desired to provide appropriate head and feet elevation for the patient, the support members are moved from their first position as illustrated in FIG. 5*a* to a second position thereof as illustrated in FIG. 5*b*. This is accomplished by rotating the shaft 41 with the motor 64, rotation of shaft 41 being transformed by bevel gears 42, 43 and threaded rod 44 into linear movement of the extension 45 to pivot the member 47 about pivot 48 and thereby elevating the roller 51 end of the lever 50 as it also pivots about pivot 48, movement of the member 47 being transferred to the lever 50 by lever 49. As lever 50 pivots about pivot 48, end 52 thereof moves the lever 53 generally downwardly, whicn in turn effects pivoting of the bell crank 55 about pivot 56 to elevate the roller 57, engaging the body support member 15', the opposite end of the lever 53 being stabilized by the member 61 which pivots about pivot point 62. Head member 14' thus pivots about hinge 19' with respect to body member 15' to the position illustrated in FIG. 5*b*, while body member 15' is pivoted with respect to head member 14' and with respect to the horizontal by the lever 55. As the body member 15' is pivoted as indicated, the foot member 16' end which is hinged by hinge 18' to the body member 15' is also elevated, while the opposite end of the foot member 16' slides along in abutment surface of the frame 12, whereby the foot member 16' also assumes an angular orientation with respect to the horizontal and the body member 15'. The position illustrated in FIG. 5*b* is referred to as the articulated position.

In order to lower the support members to their first position, it is only necessary to rotate the shaft 41 with the motor 64 in the opposite direction, which results in movement of the extension 45 in the opposite linear direction, and pivotal movement of the levers 50, 55 to their original position.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all the equivalent structures and devices.

What is claimed is:

1. A bed assembly comprising:

a frame;

a plurality of mattress support members adapted to be supported by said frame, including at least three first members, and at least three second members;

first pivot means for mounting said first members with respect to each other and said second members with respect to each other, so that said members are movable from a first position wherein said first members are substantially planar with each other and with said second members, to a second position wherein said first and second members assume an articulated position with respect to a straight line interconnecting the centers of said member;

second pivot means for mounting said first members with respect to said second members so that said first members are movable from a first position wherein they are substantially planar with said second members, to a third position wherein they make a positive angle relative to the horizontal and with respect to said second members;

first actuating means for effecting movement of second members about said first pivot means from said first to said second position, and vice versa; and second actuating means for effecting movement of said first members about said second pivot means from said first to said third position thereof, and vice versa; said second actuating means comprising lever means operatively attached to at least one of said first members, a shaft, and force transmitting means for interconnecting said shaft and said lever means for transforming rotation of said shaft into movement of said lever means to effect pivoting of said first members about said second pivot means, without interference with said first actuating means.

2. An assembly as recited in claim 1 wherein said mattress support members consist of substantially rigid, substantially planar members.

3. An assembly as recited in claim 2 wherein said support members consist of six support members.

4. An assembly as recited in claim 1 wherein said force transmitting means comprises a cable.

5. An assembly as recited in claim 1 or claim 4 wherein said lever means comprises a first lever pivotedly mounted at a first end thereof to one of said first support members and having a second end; a second lever pivotedly mounted at a first end thereof to said one of said first support members, and pivotedly mounted at a second end thereof to said first lever intermediate the ends thereof; and wherein said force transmitting means is attached to said second end of said first lever.

6. An assembly as recited in claim 1 further comprising a hand crank for rotating said shaft, and detent means for maintaining said shaft in a position to which it has been rotated.

7. An assembly as recited in claim 6 wherein said hand crank includes a toothed gear wheel, and wherein said detent means comprises a detent lever for engaging the teeth of said gear wheel.

8. An assembly as recited in claim 7 wherein said second pivot means also mounts said second members with respect to said first members so that said second members are movable from a first position wherein they are substantially planar with said first members, to a fourth position wherein they make a positive angle relative to the horizontal and with respect to said first member.

9. An assembly as recited in claim 7 wherein said first pivot means comprise hinges, and wherein said at least three first members comprise head, body, and feet members and wherein said at least three second members comprise head, body, and feet members, said hinges including hinges disposed on the tops of said members interconnecting said head and body members of each of said first and second members, and hinges disposed on the bottoms of said members interconnecting said body and feet members of each of said first and second members.

10. An assembly as recited in claim 7 wherein said at least three first members comprise head, body, and feet members, and wherein said at least three second members comprise head, body, and feet members, and wherein said second pivot means comprise hinges disposed between said head, body, and feet members respectively of first and second members.

11. A bed assembly comprising:

a frame;

a plurality of rigid mattress support members adapted to be supported by said frame, including at least three first members, and at least three second members;

first pivot means for mounting said first members with respect to each other and said second members with respect to each other, so that said members are movable from a first position wherein said first members are substantially planar with each other and with said second members, to a second position wherein said first and second members assume an articulated position with respect to a straight line interconnecting the centers of said member;

second pivot means for mounting said first members with respect to said second members so that said first members are movable from a first position wherein they are substantially planar with said second members, to a third position wherein they make a positive angle relative to the horizontal and with respect to said second members;

retaining means for retaining said first and second members in said second position thereof once they have been moved thereto; said retaining means comprising a plurality of splined shafts cooperating with splined collars, and universal joint means connecting one of said shafts and said collars to said frame, and means for connecting the other of said shafts and said collars to a support member; and actuating means for effecting movement of said first members about said second pivot means from said first to said third positions thereof, and vice versa.

12. A bed assembly comprising:

a frame;

a plurality of rigid mattress support members adapted to be supported by said frame, including at least three first members, and at least three second members; said at least three first members comprising head, body, and feet members and said at least three second members comprising head, body, and feet members;

first pivot means for mounting said first members with respect to each other and said second members with respect to each other, so that said members are movable from a first position wherein said first members are substantially planar with each other and with said second members, to a second position wherein said first and second members assume an articulated position with respect to a straight line interconnecting the centers of said member; said first pivot means comprising hinges disposed on the tops of said members interconnecting said head and body members of each of said first and second members, and hinges disposed on the bottoms of said members interconnecting said body and feet members of each of said first and second members;

second pivot means for mounting said first members with respect to said second members so that said first members are movable from a first position wherein they are substantially planar with said second members, to a third position wherein they make a positive angle relative to the horizontal and with respect to said second members;

first actuating means for effecting movement of second members about said first pivot means from said first to said second position, and vice versa; and second actuating means for effecting movement of said first members about said second pivot means from said first to said third position thereof, and vice versa.

13. A bed assembly comprising:

a frame;

a plurality of rigid mattress support members adapted to be supported by said frame, including at least three first members, and at least three second members; said at least three first members comprising head, body, and feet members, and said at least three second members comprising head, body, and feet members;

first pivot means for mounting said first members with respect to each other and said second members with respect to each other, so that said members are movable from a first position wherein said first members are substantially planar with each other and with said second members, to a second position wherein said first and second members assume an articulated position with respect to a straight line interconnecting the centers of said member;

second pivot means for mounting said first members with respect to said second members so that said first members are movable from a first position wherein they are substantially planar with said second members, to a third position wherein they make a positive angle relative to the horizontal and with respect to said second members; said second pivot means comprising hinges disposed between said head, body, and feet members respectively of first and second members;

first actuating means for effectingg movement of second members about said first pivot means from said first to said second position, and vice versa; and second actuating means for effecting movement of said first members about said second pivot means from said first to said third position thereof, and vice versa.

* * * * *